United States Patent [19]

Patnode et al.

[11] 4,018,583

[45] Apr. 19, 1977

[54] REFRIGERATION HEAT RECOVERY SYSTEM

[75] Inventors: Marvin M. Patnode, Georgetown; Louis H. Leonard, Dewitt, both of N.Y.

[73] Assignee: Carrier Corporation, Syracuse, N.Y.

[22] Filed: May 24, 1976

[21] Appl. No.: 689,012

Related U.S. Application Data

[60] Division of Ser. No. 599,518, July 28, 1975, which is a continuation-in-part of Ser. No. 523,625, Nov. 14, 1974, abandoned.

[52] U.S. Cl. ..... 62/101; 62/115

[51] Int. Cl.[2] ..... F25B 15/00; F25B 1/00

[58] Field of Search ..... 62/88, 84, 101, 115, 62/468, 476, 483; 165/63

[56] References Cited

UNITED STATES PATENTS

| | | | |
|---|---|---|---|
| 3,811,291 | 5/1974 | Schibbye | 62/84 |
| 3,922,873 | 12/1975 | Leonard | 62/115 |

*Primary Examiner*—Lloyd L. King
*Attorney, Agent, or Firm*—J. Raymond Curtin; Thomas J. Wall

[57] ABSTRACT

A combination vapor compression and refrigeration cycle employing a mechanical compressor for developing high temperatures. The suction end of the compressor is exposed to both the vapors discharged from the refrigeration evaporator and a mixture of oil foam and refrigeration vapors discharged from an absorption generator. As the mixture passes through the compressor, it absorbs the heat of compression and is discharged into a heat exchanger where energy is transferred to a reclaiming substance. Because of the absorptive process, relatively high temperatures are developed in the compressor discharge whereby the energy rejected into the reclaiming substance can be effectively utilized in domestic and industrial heating applications.

11 Claims, 2 Drawing Figures

REFRIGERATION HEAT RECOVERY SYSTEM

This is a division of application Ser. No. 599,518 filed July 28, 1975, which is a continuation-in-part of application Ser. No. 523,625 filed Nov. 14, 1974, now abandoned.

BACKGROUND OF THE INVENTION

This invention relates to a circuit for developing high temperatures in a vapor compression refrigeration system employing a mechanical compressor.

Typically, in a vapor compression refrigeration system, a good deal of energy is developed on the high pressure side of the system. However, because of the thermodynamic characteristics of most refrigerants, the temperature of the energy rejected from the system is relatively low. As a consequence, this rejected energy cannot be readily recovered for utilization in most domestic and industrial heating applications.

SUMMARY OF THE INVENTION

It is therefore an object of the present invention to improve refrigeration systems employing a mechanical compressor.

A further object of the present invention is to develop high temperatures at the discharge side of a compressor as conventionally employed in a vapor compression refrigeration system.

It is another object of the present invention to provide a high temperature heat reclaiming circuit that is adapted for use in a refrigeration system having a screw compressor.

These and other objects of the present invention are attained by means of a high temperature circuit suitable for use in a conventional refrigeration system utilizing a mechanical compressor, the circuit including a heat exchanger operatively connected to the discharge of the compressor and a generator connected to the suction side of the compressor. A concentrated absorbent solution is drawn from the generator by the compressor and exposed to refrigerant vapors discharged from the refrigeration evaporator either at the compressor inlet or within the compressor. The mixture, upon passing through the compressor, picks up the heat of compression and is discharged into the heat exchanger with the entrained refrigerant vapors. In the exchanger, the mixture is brought into heat transfer relation with a cooler reclaiming substance whereby at least a portion of the available refrigeration vapors are absorbed by the solution, thus raising the temperature of the mixture above the saturation temperature of the refrigerant. The high temperature energy is rejected into the reclaiming substance and carried out of the system for recovery. The unabsorbed refrigerant vapors and the diluted solution are then separated and passed in heat exchange relation through the generator. Prior to entering the generator, the diluted solution is flash cooled by exposing the solution to the suction side of the compressor. In the generator, the energy in the high pressure unabsorbed vapors is rejected into the diluted solution to reconcentrate the solution and at least partially condense the unabsorbed refrigerant. Finally, any refrigerant that is not condensed in the generator is passed through the refrigeration condenser and the liquid refrigerant from both the generator and the condenser collected for reuse in the refrigeration cycle. The reconcentrated solution and evaporate from the refrigeration system are brought together at the compressor and the cycle repeated.

BRIEF DESCRIPTION OF THE DRAWINGS

For a better understanding of the instant invention, as well as other objects and further features thereof, reference is had to the following description of the invention to be read in conjunction with the accompanying drawings, wherein.

DESCRIPTION OF THE PREFERRED EMBODIMENT

Figure 1:
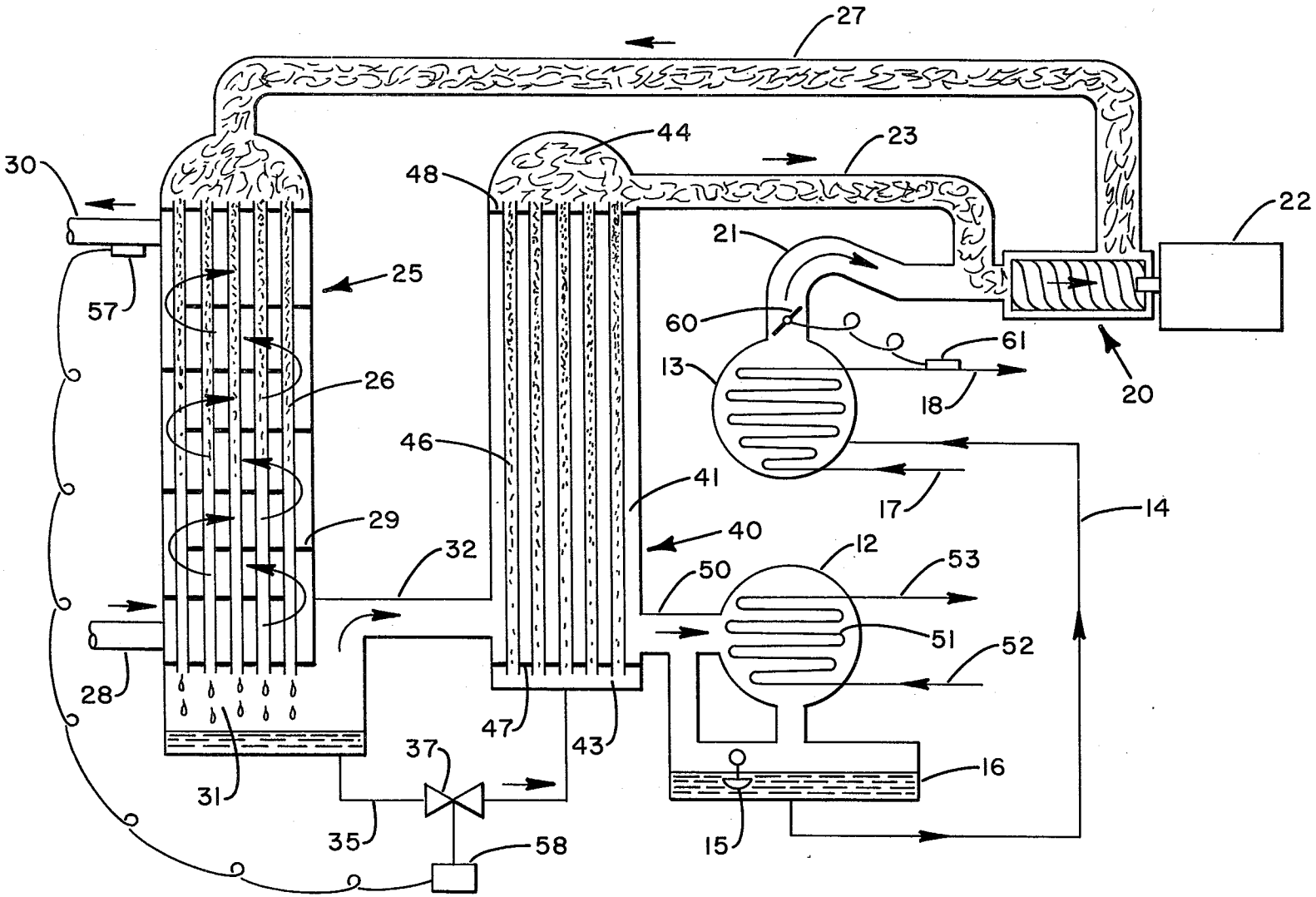
FIG. 1 is a schematic representation of a vapor compression refrigeration system embodying the high temperature circuit of the present invention.

Referring now to FIG. 1, there is shown a schematic representation of a vapor compression refrigeration system 10 employing a screw compressor 20 embodying the teachings of the present invention for developing a high temperature lift. The refrigeration system includes a condenser 12 and an evaporator 13. The condenser and evaporator are connected by means of an expansion valve 15 located in float chamber 16 and refrigerant line 14. The substance to be chilled, which can be water or the like, is fed into the evaporator via an inlet pipe 17, passed through a series of evaporator tubes where heat is rejected from the warmer substance into the refrigerant, and then passed from the system by means of an outlet pipe 18. Refrigerant, in vapor form, leaves the evaporator and is delivered to the suction side of compressor 20 by means of inlet channel 21. As illustrated, compressor 20 is a conventional screw compressor driven by any suitable drive means 22, as for example an electrical motor. Although the screw compressor is ideally suited for use in the present invention, it should be clear from the discussion below that any suitable mechanical compressor can be employed in the practice of the present invention.

Typically, in most conventional vapor compression refrigeration systems, the refrigerant leaves the compressor in a saturated vapor state. The saturation temperature of most commercially available refrigerants seldom exceeds 120° F. As a consequence, the temperature of the energy rejected from the system is relatively low and is thus not readily reclaimable for use in most heating applications. The work required of the compressor to elevate the refrigerant temperatures beyond saturation increases drastically as the temperature requirements increase. As a result, increasing the temperature lift of the refrigeration system by mechanical means becomes economically unfeasible. In addition, the decomposition rate of most known refrigerants increases drastically when the substance is driven beyond saturation within the compressor. This, in turn, places further restrictions on a strictly mechanical approach to producing elevated temperatures on the high pressure side of a refrigeration system.

The present invention overcomes these long-standing difficulties in the art by providing a high temperature circuit on the high pressure side of the refrigeration system which takes advantage of the absorptive principle to attain elevated temperatures without the need of increasing the lift producing capability of the compressor. As shown in the drawing, the apparatus of the high lift circuit includes an absorber 25 and a generator 40. The high lift circuit is operatively connected to the refrigeration system between the discharge of the refrigeration evaporator 13 and the inlet to the refrigeration condenser 12. As a result, the high lift circuit can be conveniently retrofitted to existing units presently operating in the field without having to resort to major component changes or modifications.

As illustrated in FIG. 1, concentrated solution of an absorbent is delivered by solution intake pipe 23 into the refrigerant inlet channel 21 whereby the solution is exposed to the refrigerant vapors at the inlet to the compressor. The mixture of pure refrigerant vapors and concentrated solution is passed through the compressor, increasing the pressure of the mixture and delivering the mixture to the high pressure side of the refrigeration system. The solution can similarly be brought into exposure with the refrigerant within the compressor by injecting the solution directly into the compressor downstream of the inlet. Under the influence of the compressor, the mixture of solution and refrigerant is pumped downstream into the absorber-generator circuit by means of the compressor discharge line 27. As it passes through the compressor, the energy level within the mixture is raised to a level sufficient to bring the refrigerant to a saturated or slightly superheated state.

The absorber unit 25 is a single-pass heat exchanger having a vertically aligned tube bundle 26 arranged to carry the high temperature mixture downwardly through the absorber shell where the absorbent solution wets the inside surfaces of the tubes. A heat reclaiming substance, which can be water or any other substance having a high coefficient of thermal conductivity, is delivered into the bottom portion of the absorber shell by inlet pipe 28 and caused to move generally in an upward direction through the shell. The flow is directed back and forth over the outer surface of the exchanger tubes by means of segmented baffles 29, thus establishing an efficient counterflow heat transfer relationship between the reclaiming substance and the high temperature mixture moving downwardly through the tubes. The heat reclaiming substance is discharged from the absorber unit by means of pipe 30 and delivered into any suitable downstream device for recovering the energy contained therein.

As the mixture moves from the compressor into the absorber, the concentrated solution in the mixture begins to absorb the saturated refrigerant. Upon entering the absorber unit, the mixture moves downwardly through the tube bundle in heat transfer relation with the heat reclaiming substance whereby energy (heat) is rejected into the reclaiming substance. As energy is rejected from the mixture, the rate of absorption increases. By design, the high lift circuit is arranged so that one-half, or less than one-half, of the total volumetric refrigerant flow passing through the compressor is absorbed in the concentrated solution when the circuit is operating under peak heating loads. Accordingly, 50% or more of the available energy in the refrigerant vapors discharged from the compressor remain in a pure or unabsorbed state at the discharge side of the absorber unit. The remaining 50% or less of refrigerant discharged by the compressor is condensed in the solution to perform the necessary work to raise the temperature mixture to a temperature level beyond that of the saturation temperature of the pure refrigerant. As will be explained in further detail below, the energy retained in the unabsorbed refrigerant vapors is employed downstream from the absorber unit to reconcentrate the diluted solution. Because the absorption process is basically a reversible process, approximately the same amount of energy is consumed in the absorption process as is required to reconcentrate the solution. By maintaining an energy balance in the manner herein described, there is always sufficient internal energy contained within the system to reconcentrate the solution for all heating loads.

The mixture leaving the tube bundle of the heat reclaiming exchanger, passes directly into separating chamber 31. In the separator, the unabsorbed refrigerant vapors are gravity separated from the now dilute liquid solution. The liquid solution is collected in a reservoir area at the bottom of the chamber, while the unabsorbed refrigerant vapors are permitted to pass through channel 32 into downstream generator 40. The generator 40, which is a second heat exchanger, is arranged to function as a means for reconcentrating the diluted solution and at least partially condensing the unabsorbed refrigerant vapors leaving the absorber.

Referring now to the generator construction, it can be seen that the unit is separated into a centrally located high pressure section 41 and a low pressure section that includes end chambers 43 and 44 placed in fluid flow communication by means of a series of tubes 46 passing through the high pressure section. The low pressure section of the generator is operatively connected to the suction side of the compressor by line 23 to maintain this section at the compressor inlet pressure. The high pressure section of the generator, which is isolated from the low pressure section by end wall 47, 48, is maintained at substantially the compressor discharge pressure.

The liquid dilute solution collected in the separator is brought into the low pressure side of the generator through line 35. Prior to entering the generator, the dilute solution is flash cooled by passing the fluid through expansion valve 37. As a result, the solution is throttled from the high pressure side of the system to the low pressure side.

The flash cooled solution is delivered into the generator within chamber 43 and is immediately brought under the influence of the compressor inlet and drawn upwardly through tubes 46. The vapors of the unabsorbed refrigerant, which are at a relatively higher temperature and pressure than the solution, are drawn from the separator into the high pressure section of the generator and caused to move over the outer surface of the heat exchanger tubes. As a consequence, the vapors condense, or at least partially condense, on the tube surfaces and the heat of condensation passed to the solution within the tubes. The vapor pressure of the solution within the tubes, being at the compressor inlet pressure, is relatively low and, as a result, the refrigerant therein is readily driven from the solution. The mixture containing freed refrigerant and the concentrated solution is transported to the compressor for reuse in the cycle.

The pure unabsorbed refrigerant vapors passing through the high pressure section of the generator enter a split discharge 50. In the discharge, condensed refrigerant, which is now in a liquid phase, is dumped directly into the float chamber 16 of the refrigeration system. The uncondensed vapors leaving the generator are carried upwardly into conventional refrigeration condenser 12 where the vapors are reduced to a liquid in a conventional manner by a coolant circulated through a condenser coil 51 by inlet piping 52 and outlet piping 53. The condensate generated in condenser 12 is also discharged into float chamber 16 where it is collected with condensate from generator 40. As can be seen, the generator 40 and condenser 12 combine to share the work of condensation, the amount of work performed by each unit being dependent upon the heating and cooling demands placed on the system.

Control of the heat reclaiming process is maintained in the high lift circuit in response to the temperature of the reclaiming substance leaving the heat reclaiming exchanger 25. A sensing element 57 is positioned adjacent to the outlet pipe 30 and arranged to sense the temperature of the reclaiming substance leaving the absorber unit. Temperature information is sent to regulator 58 operatively connected to the expansion valve 37 which, in turn, controls the flow of dilute solution therethrough. When the temperature of the reclaiming substance leaving the absorber moves away from a desired level, a signal is sent to the regulator which adjusts the expansion valve setting to either increase or decrease the amount of solution delivered to the generator thus bringing the temperature back to the desired condition.

The rate of flow of solution through the generator is thus controlled which, in effect, regulates the flow of solution through the absorber unit 25. This, in turn, determines the amount of refrigerant energy that is consumed in the high lift absorption process and the amount of energy that is available in the unabsorbed refrigerant vapors to reconcentrate the diluted solution. Because of the present absorber-generator arrangement, the high lift circuit is capable of balancing the work carried by the two units to maintain the system at the desired heating load. For example, if more than the required amount of energy is consumed in the absorption process for a preselected heating load, the state of the solution leaving the absorber will become overly dilute. As a result, the amount of energy contained in the unabsorbed refrigerant vapors passing into the generator will be proportionally reduced thereby lowering the amount of energy available for reconstituting the solution. The concentration of the solution leaving the generator, therefore, becomes correspondingly weak in its ability to absorb refrigerant. Accordingly, less energy is consumed in the absorption process during the next cycle. By the same token, when the solution delivered into the absorber is relatively dilute, less refrigerant is absorbed and more energy becomes available in the unabsorbed vapors for reconcentration. This, in turn, results in a strengthening of the solution leaving the concentrator during the next cycle. In practice, this balancing process continues for each subsequent cycle until a proper energy relationship is established between the absorber and the generator for the desired heating load.

The cooling capacity of the refrigeration system is controlled by means of a butterfly damper valve 60, or any other similar device, for regulating the amount of refrigerant flow passing through inlet 21 connecting the evaporator discharge with the compressor inlet. The position of the damper plate is regulated in response to the temperature of the chilled substance leaving the evaporator sensed by sensing element 61 at the cooling substance discharge. In operation, the screw compressor is permitted to run at maximum operating speed (wide open) at all times whereby the compressor pulls on the generator with a maximum head to generate the highest concentration of solution as possible. In this manner, conventional slide valve controls or the like, which would act to offset the work balance within the generator, are avoided. As can be seen, a relatively simple control system is herein provided which permits the heating and cooling loads on the system to regulate independently.

Figure 2:
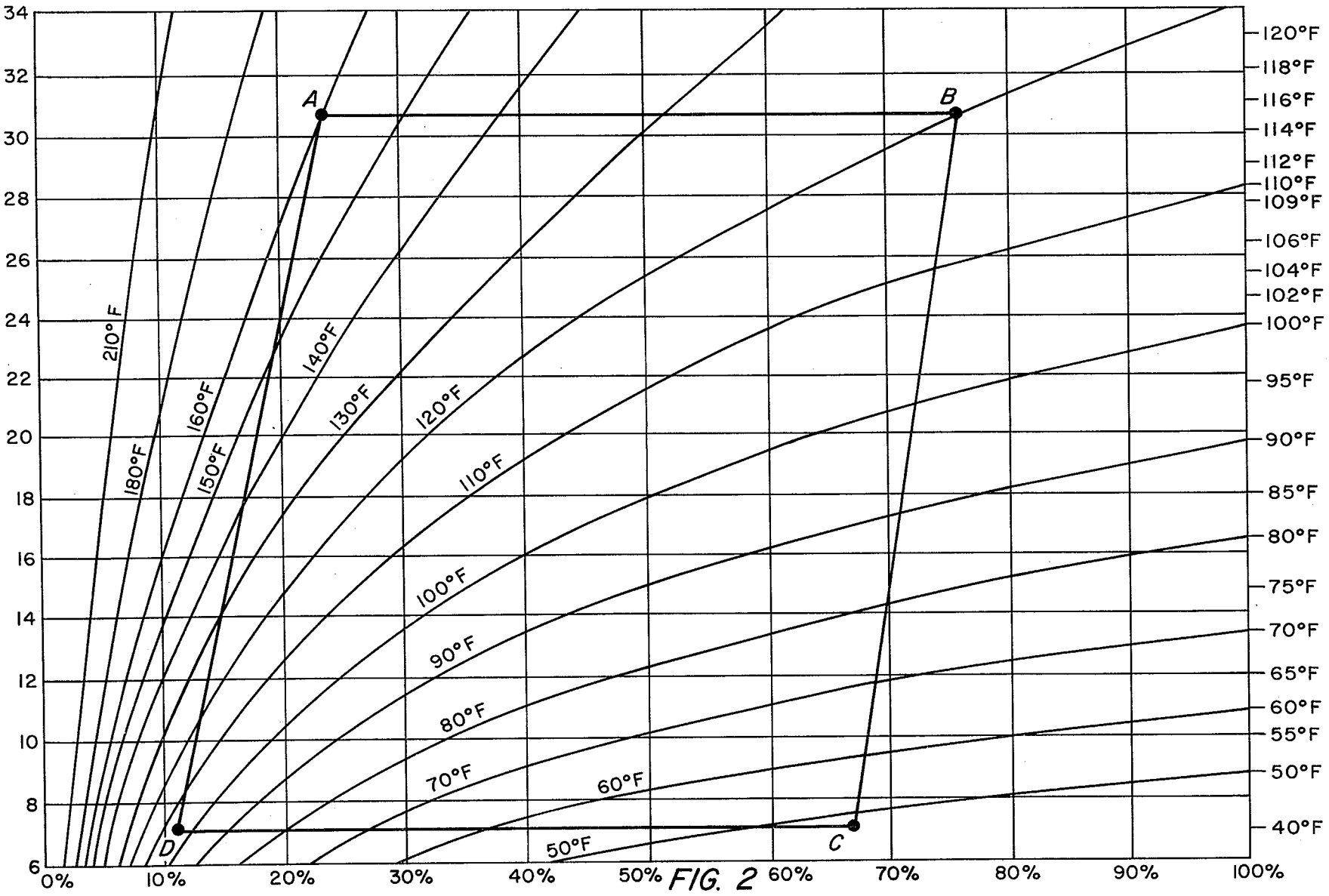
FIG. 2 is a diagrammatic representation illustrating the state conditions of a typical absorbent-refrigerant mixture as it moves through the high temperature circuit shown in FIG. 1.

Referring now to the diagram shown in FIG. 2, the high lift circuit will be explained in reference to the state of the solution as it passes therethrough. For purposes of explanation, the cycle shown is plotted for a system utilizing Freon R-11 as a refrigerant and utilizing a lubricating oil, such as Texaco URSA, as an absorbent. As can be seen, this combination of working fluids is ideally suited for use in conjunction with a screw compressor in that the oil is capable of delivering lubrication to the compressor as it passes therethrough. The refrigerant concentration of the solution is plotted along the abscissa of the diagram and represents a percentage of the concentration by weight. The left-hand ordinate is a plot of the solution vapor pressure in psia with the corresponding saturated condensing temperature of the refrigerant noted along the right-hand ordinate. The saturated temperature of the solution is also plotted upon the diagram and is represented by the curves running obliquely therethrough.

Point A on the diagram represents the discharge pressure of the compressor which is also the entrance pressure to the absorber heat exchanger 25. As noted for the typical example of the system employing R-11 as a refrigerant, the discharge pressure of the compressor is approximately 30.5 psia. At this particular discharge pressure, the saturation temperature of the refrigerant vapors is about 115° F. The temperature of the solution moving through the absorber will attain a concentration of approximately 23% thus raising the solution temperature to about 160° F. This high temperature mixture, as it moves through the absorber heat exchanger, rejects energy into the reclaiming substance thus raising the substance temperature to approximately that of the high temperature mixture. As the solution continues to reject heat into the reclaiming substance, the solution becomes diluted and eventually leaves the exchanger at state point B. As noted on the plot, the solution is now at about 120° F and is diluted down to a concentration of about 76.6%.

The solution and the unabsorbed refrigerant vapors, which are still at or about saturation, leave the heat exchanger of the absorber unit and are brought into the separator 31 where the components are separated as described above. The separated dilute solution is flash cooled from state B down to state C by passing the solution through expansion valve 37. As noted, flash cooling is accomplished by reducing the solution pressure from the discharge pressure of the compressor to the inlet pressure thereof or from about 30.5 psia to about 7 psia. Flash cooling, under these conditions, changes the solution concentration from 76.6 to about 68%, while reducing the solution temperature to 45° F. The solution is brought into the generator in this condition.

Within the generator, the solution comes into thermal communication with the unabsorbed refrigerant vapors passing over the tube bank, the vapors still being at or about saturation conditions. The now cooler dilute solution acts to condense the unabsorbed vapors and the latent heat of condensation is rejected into the solution. The solution, which is exposed to the inlet conditions of the compressor, boils, driving off refrigerant and thus reconcentrating the solution to state point D. During the reconcentration process, the solution supply in the generator is ideally brought from about 67% refrigerant to about 10.5%, while the temperature of the solution is raised to about 105° F.

The reconcentrated solution and the vapors driven therefrom move through channel 23 to the inlet of the screw compressor. At the inlet to the compressor, the mixture leaving the generator is exposed to the pure refrigerant vapors leaving the evaporator and the cycle is once again repeated.

While this invention has been described with reference to the structure herein disclosed, it is not necessarily confined to the details as set forth, and this application is intended to cover any modifications or changes as may come within the scope of the following claims.

We claim:

1. The method of developing a high temperature lift within the working fluid employed in a vapor compression refrigeration system wherein the suction side of the compressor is operatively connected to an evaporator including the steps of exposing refrigerant moving from the evaporator through the compressor to a concentrated absorbent solution whereby a mixture of refrigerant vapor and solution is discharged from the compressor, delivering the mixture discharged from the compressor into a heat exchanger, and bringing a heat reclaiming substance into heat transfer relationship with the mixture within the exchanger whereby high temperature energy developed in the mixture as the concentrated solution absorbs the refrigerant vapors is transferred to the reclaiming substance.

2. The method of claim 1 further including the step of reconcentrating the diluted solution after energy is transferred into the reclaiming substance.

3. The method of claim 2 further including the step of regulating the amount of refrigerant absorbed by the solution so that less than 50% of the refrigerant moving through the compressor is absorbed by the solution.

4. The method of claim 3 wherein the energy contained in the unabsorbed refrigerant is employed to reconcentrate the solution.

5. The method of developing high temperatures within the working fluids of a vapor compression refrigeration system having the suction end of a compressor operatively connected to an evaporator including exposing refrigerant vapors moving between the evaporator and the compressor to a concentrated absorbent solution, passing the mixture of solution and vapors through the compressor to raise the state of the mixture, pumping the mixture, under the influence of the compressor, through a heat exchanger, bringing a reclaiming substance into heat exchange relation with the mixture moving through the exchanger whereby at least a portion of the refrigerant vapors in the mixture are condensed as they are absorbed into the solution and the energy developed in the mixture is rejected into the reclaiming substance, and reconcentrating the solution for reuse in the process.

6. The method of claim 5 further including the step of separating unabsorbed refrigerant vapors from the diluted solution leaving the heat exchanger.

7. The method of claim 6 wherein reconcentration of the solution is accomplished by bringing the separated dilute solution in heat exchange relation with the unabsorbed refrigerant within a generator.

8. The method of claim 7 further including the step of flash cooling the dilute solution prior to bringing the solution into the generator.

9. The method of claim 8 further including the step of exposing the flash cooled solution to the suction end of the compressor during reconcentration.

10. The method of claim 9 further including the step of controlling the flow of dilute solution into the generator in response to the temperature of the reclaiming substance.

11. The method of claim 10 further including controlling the flow of refrigerant vapors from the evaporator to the inlet of the compressor in response to the temperature of a substance chilled in the evaporator.

* * * * *